US005339136A

United States Patent [19]

Parsons et al.

[11] Patent Number: 5,339,136

[45] Date of Patent: Aug. 16, 1994

[54] IMAGE FORMING APPARATUS HAVING IMAGE REGISTRATION MEANS

[75] Inventors: Michael H. Parsons, Arvada, Colo.; Kevin M. Johnson, Rochester, N.Y.

[73] Assignee: Eastman Kodak Company, Rochester, N.Y.

[21] Appl. No.: 51,929

[22] Filed: Apr. 26, 1993

[51] Int. Cl.[5] ..... G03G 21/00

[52] U.S. Cl. ..... 355/208; 355/203; 355/204; 355/271; 355/272; 355/273; 355/317; 355/326 R; 355/327

[58] Field of Search ..... 355/271-274, 355/277, 326, 327, 203, 204, 208, 316, 317, 326 R; 346/157

[56] References Cited

U.S. PATENT DOCUMENTS

| | | | |
|---|---|---|---|
| 4,705,386 | 11/1987 | Ogita et al. | 355/327 |
| 4,796,054 | 1/1989 | Maeno et al. | 355/243 |
| 4,872,037 | 10/1989 | Kasahara et al. | 355/271 |
| 4,975,741 | 12/1990 | Tanaka | 355/208 X |
| 4,994,827 | 2/1991 | Jamzadeh et al. | 346/157 |
| 5,021,829 | 6/1991 | Johnson et al. | 355/271 X |
| 5,021,835 | 6/1991 | Johnson | 355/271 |
| 5,040,026 | 8/1991 | Jamzadeh et al. | 355/271 |
| 5,043,761 | 8/1991 | Johnson | 355/326 |
| 5,047,791 | 9/1991 | Jamzadeh et al. | 346/157 |
| 5,130,748 | 7/1992 | Tanaka | 355/208 X |
| 5,140,379 | 8/1992 | Johnson | 355/272 X |
| 5,185,634 | 2/1993 | Muramatsu | 355/327 X |
| 5,235,392 | 10/1993 | Hediger | 355/271 |

*Primary Examiner*—Matthew S. Smith
*Attorney, Agent, or Firm*—Leonard W. Treash

[57] ABSTRACT

Drum-shaped image and transfer members are controlled by a set of sensors and flags which determine the position of the leading edge of a toner image as it approaches a transfer zone and the leading edge of a receiving sheet as it approaches the transfer zone. A logic and control controls the speed of the transfer drum as it approaches the transfer zone to assure a predetermined spacial relationship between the two leading edges. The leading edge of the receiving sheet is sensed on the transfer drum by sensing a difference in reflectivity between the sheet and a low reflectivity area which the sheet overlies.

6 Claims, 4 Drawing Sheets

IMAGE FORMING APPARATUS HAVING IMAGE REGISTRATION MEANS

This invention relates to the registration of a toner image on a receiving sheet. Although not limited thereto, it is particularly usable in the registration of a plurality of different color toner images on a receiving sheet to form a multicolor image.

U.S. Pat. No. 5,040,026, issued Aug. 13, 1991 to Jamzadeh et al, and U.S. Pat. No. 5,047,79, issued Sep. 10, 1991 to Jamzadeh et al, show various embodiments of an image forming apparatus in which a series of different color toner images are formed on an image member and the images are transferred in registration to a receiving sheet carried on a transfer member to form a multicolor image on the receiving sheet. The image member and transfer member are in substantial transfer contact during transfer but are not in contact between transfer of images. The image member is moved continuously at a constant speed. To assure registration of the images on the receiving sheet, however, the transfer member is reindexed between image transfers. For example, the image member can be a transfer drum which is stopped where a transfer drum flag is sensed by a transfer drum control sensor and then, upon determination of a particular location with respect to the image associated with the image member, the transfer drum is started up again with its movement carefully controlled so that the leading edge of consecutive images coincide to provide a high quality multicolor image.

U.S. Pat. No. 5,047,791 also suggests to create as many as nine small toner images on a single receiving sheet and then slit and cut the receiving sheet after the images have been finished. In such a system, it is desirable not to trim borders and, therefore, imaging is done to the edge of the sheet. Thus, it is important not only that the single color toner images overlay each other precisely but that they fit on the receiving sheet with a precisely maintained relationship between the edges of the toner images and the edges of the receiving sheet. See also U.S. Pat. Nos. 5,043,761; 4,994,827; and 5,021,835.

U.S. Pat. No. 4,872,037, granted Oct. 3, 1989 to Kasahara et al, references prior art in which an edge of a receiving sheet is sensed on a transfer drum and the speed of the transfer drum is adjusted with respect to a start-of-scan signal to assure proper placement of a toner image on the receiving sheet. See also, U.S. Pat. No. 4,796,054.

SUMMARY OF THE INVENTION

It is an object of the invention to provide an image forming apparatus in which a toner image is transferred from an image member to a receiving sheet carried on a transfer member in which registration of the toner image with respect to the receiving sheet is improved.

This and other objects are accomplished by an image forming apparatus having a transfer member movable through an endless path through a transfer zone. The transfer member has means for securing a receiving sheet having a leading edge to the transfer member for movement through at least a portion of the endless path. An image member is movable through an endless path through transfer relation with a secured receiving sheet in the transfer zone. The apparatus includes means for forming an electrostatic image having a leading edge on the image member, means for applying toner to the electrostatic image to form a toner image having a leading edge on the image member and a first determining means for determining the location of the leading edge of the electrostatic-image or the toner image on the image member. The transfer member includes a sensible means indicative of the approximate location of the leading edge of a receiving sheet, and the apparatus includes a sensing means for sensing the distance between the actual leading edge of the receiving sheet and the sensible means indicative of the approximate location. The apparatus also includes a second determining means for determining the location of the sensible means. A logic and control includes means for adjusting the motion of the transfer member to assure a predetermined spacial relationship between the leading edge of the toner image and the leading edge of the receiving sheet in response to the sensing means and the first and second determining means.

According to a preferred embodiment, the transfer member is a transfer drum which includes an indicia that optically contrasts from the receiving sheet, for example, a black area on the drum periphery. The apparatus includes means for feeding the receiving sheet onto the periphery of the transfer drum with its leading edge as close as possible to a location in the middle of the contrasting indicia. The sensing means is an optical sensing means which senses the leading edge of the indicia, for example, the black area, and the leading edge of the receiving sheet which contrasts optically with the indicia. A flag on the transfer drum is sensed by the second determining means. The flag on the transfer drum is at or is a known distance from the contrasting indicia. The logic and control responds to the second determining means to control the speed of the transfer drum as it moves the receiving sheet toward the transfer zone, but that control is adjusted by the difference determined between the leading edge of the receiving sheet and the leading edge of the indicia to provide a precise control of the transfer of the leading edge of the toner image with respect to the leading edge of the receiving sheet.

With the preferred embodiment of the invention, the leading edge of each toner image can be placed precisely with respect to the leading edge of the receiving sheet. Thus, each of the toner images will not only be precisely registered with respect to each other, they will be precisely registered with respect to the receiving sheet. Having such precise registration on the receiving sheet has a number of advantages in many applications. However, it is of greatest importance when imaging is done up to the edge of the receiving sheet. In such instances, the invention eliminates the necessity of trimming. It also allows any cutting of the receiving sheet to be done by automatic equipment, responsive to the same leading edge of the receiving sheet.

Further, since the edge of the receiving sheet is sensed with each image, failure of the receiving sheet to maintain position is compensated for in image-to-image registration. This is an important feature of the preferred embodiment because vacuum efficiency in many systems is difficult to maintain.

DESCRIPTION OF THE PREFERRED EMBODIMENTS

Figure 1:
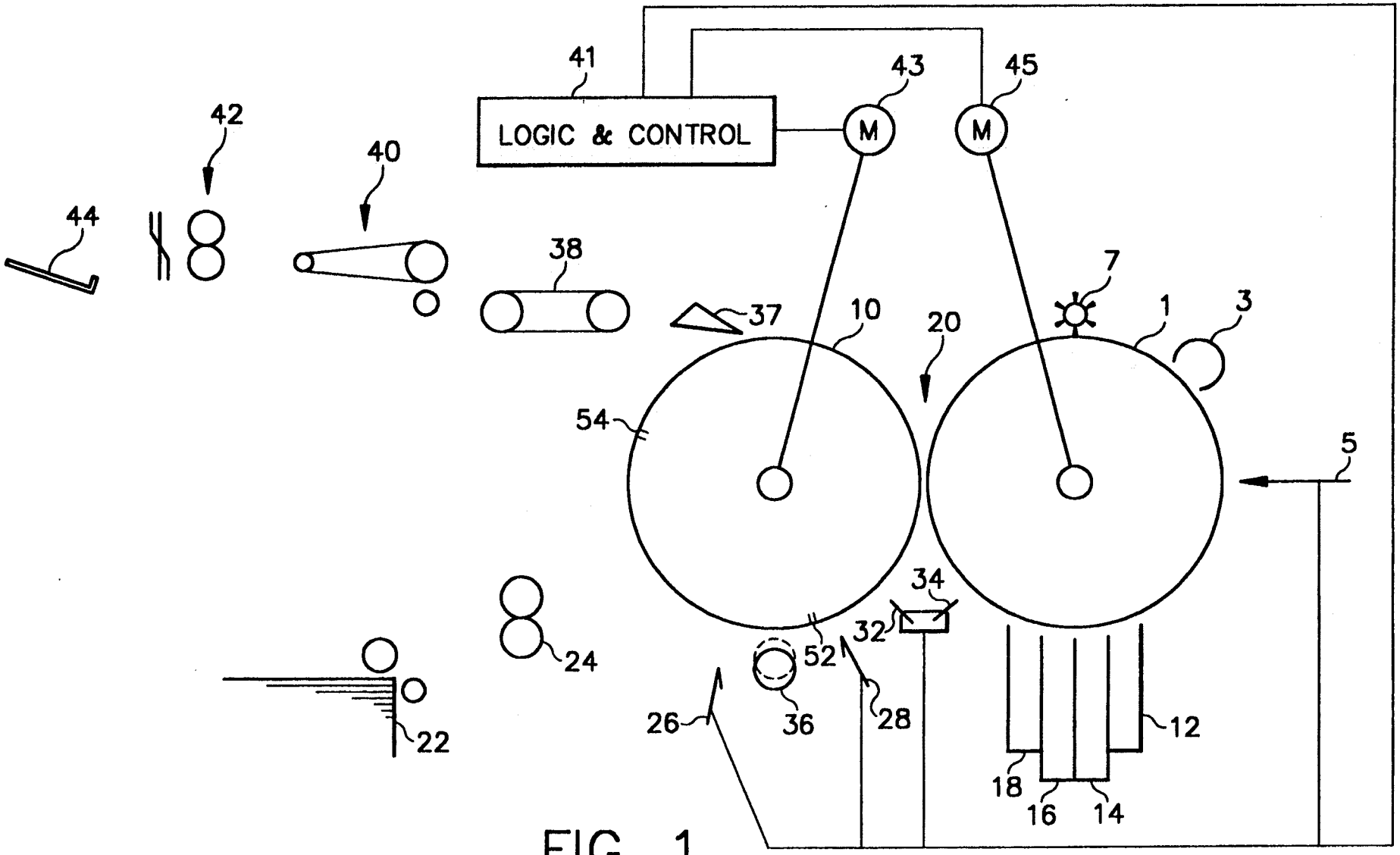
FIG. 1 is a side schematic of an image forming apparatus.
Figure 2:
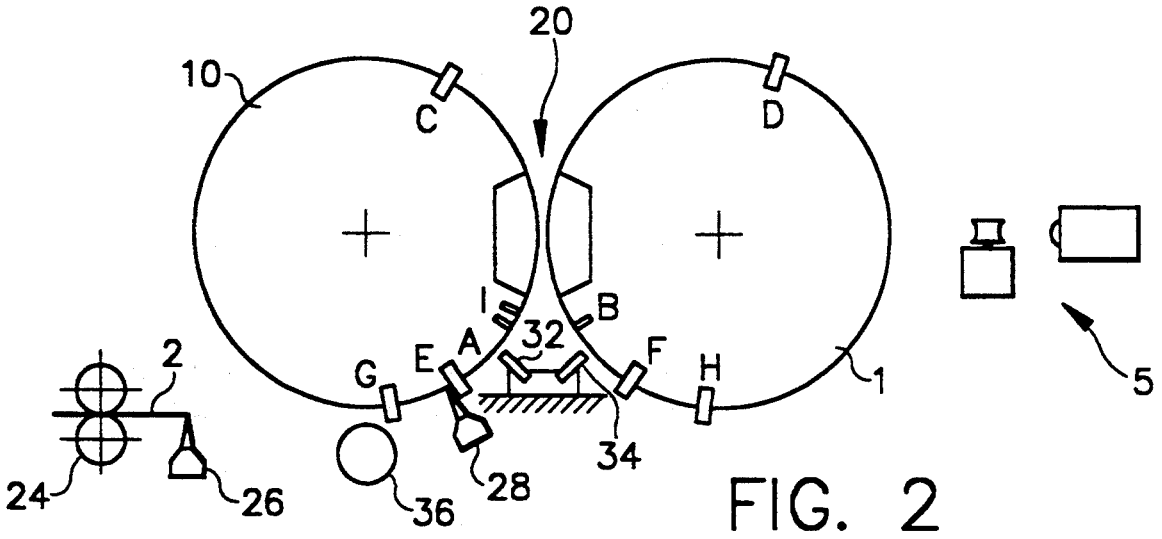
FIGS. 2–8 are side schematics illustrating various steps in the operation of the image forming apparatus shown in FIG. 1.

An image forming apparatus shown in FIG. 1 includes an image member 1 and a transfer member 10 which are both shown as drums and which are designed to form multicolor images. This preferred embodiment derives great benefit from use of the invention. However, the invention can also be used in image forming apparatus which form a single color image on a receiving sheet and image forming apparatus of multiple or single color type in which the image member and/or transfer member is in a form other than a dram. For example, either or both can be endless belts.

Referring to FIG. 1, image member 1 is a photoconductive drum upon which a series of electrostatic images are formed by a charging device 3 and an exposure device, for example, a laser 5. The series of electrostatic images are toned by the application of different color toners to each of the images by a series of toning stations 12, 14, 16 and 18. A cleaning device 7 cleans the image member 1 before formation of the electrostatic images.

The receiving sheet is fed from a receiving sheet supply 22 to a pair of registration rollers 24, past a receiving sheet sensor 26 and onto the periphery of drum-shaped transfer member 10. The receiving sheet is held on the periphery of transfer member 10 by a suitable means, for example, a leading edge vacuum 54 and a trailing edge vacuum 52 which secure the receiving sheet to transfer member 10. Intimate contact between the receiving sheet and the transfer member 10 can be improved by a roller 36 which is moved into contact with the receiving sheet as it is secured to transfer member 10 to force such intimate contact. In operation, the receiving sheet is rotated through a transfer zone 20 while held on the periphery of transfer member 10 by vacuums 52 and 54. The series of toner images is transferred in registration to the receiving sheet to form a multicolor image thereon, one toner image being transferred for every rotation of transfer member 10 and each pass of the receiving sheet through transfer zone 20. After the multicolor image has been formed, a paper skive 37 is moved into engagement with the receiving sheet to separate it from transfer member 10. The separated receiving sheet is transported by transport 38 to a finishing device, for example, a fuser 40 and a cutting device 42. Ultimately, the receiving sheet, after finishing, is deposited in an output tray 44.

Control of image formation and transfer, as well as the rest of the apparatus, is handled by logic and control 41 which controls a motor 43 which variably drives transfer member 10 and a motor 45 which drives image member 1 at a constant speed. Control of the movement of transfer member 10 by logic and control 41 is effected in response to signals received from a transfer member position sensor 32, an image member position sensor 34 and leading edge sensor 28. Logic and control 41 also controls the beginning of scan of laser 5 and also receives sufficient input from laser 5 to determine when scan actually began.

Referring to FIGS. 2–8, the control system referred to above is explained step by step. Image member 1 contains flags D, H and F which are capable of being sensed by image member position sensor 34 as the flags pass the sensor. Similarly, transfer member 10 contains flags C, E and G which are sensed as they pass or arrive at transfer member position sensor 32.

Figure 9:
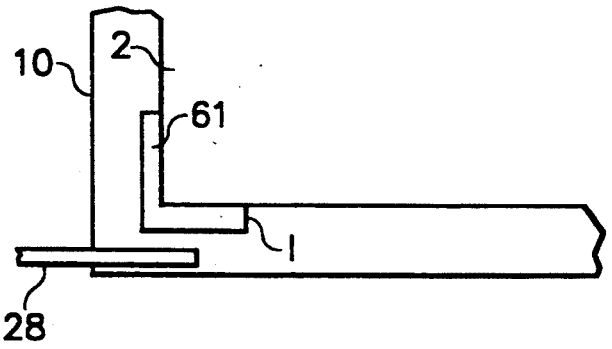
FIG. 9 is a bottom view of a portion of a transfer drum and receiving sheet of the image forming apparatus shown in FIG. 1.

Referring to FIG. 9, the periphery of transfer member 10 contains an indicating area 61 which contrasts optically with a receiving sheet 2 that is positioned partially overlapping it. Leading edge sensor 28 is positioned to sense both the leading edge I of the indicating area 61 and the leading edge of the receiving sheet 2 and provide a signal indicative of the distance between the two. This provides the logic and control with information indicating the distance between the leading edge of the receiving sheet and a nominal position. Since the nominal position is known with respect to the flags, for example flag E, this allows control of transfer member 10 with respect to the exact location of the leading edge of the receiving sheet.

Figure 3:
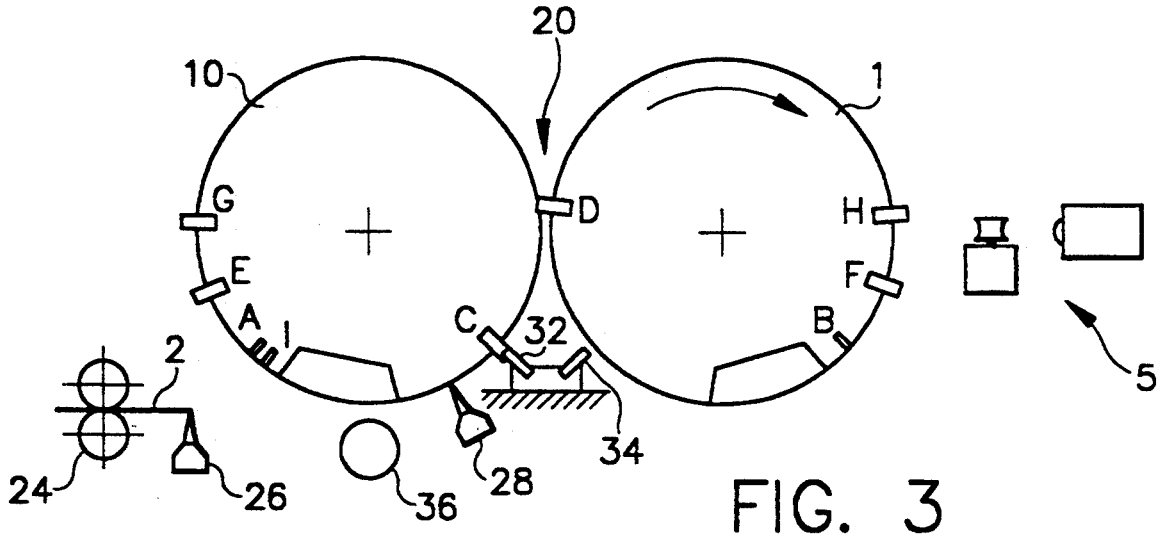
Figure 4:
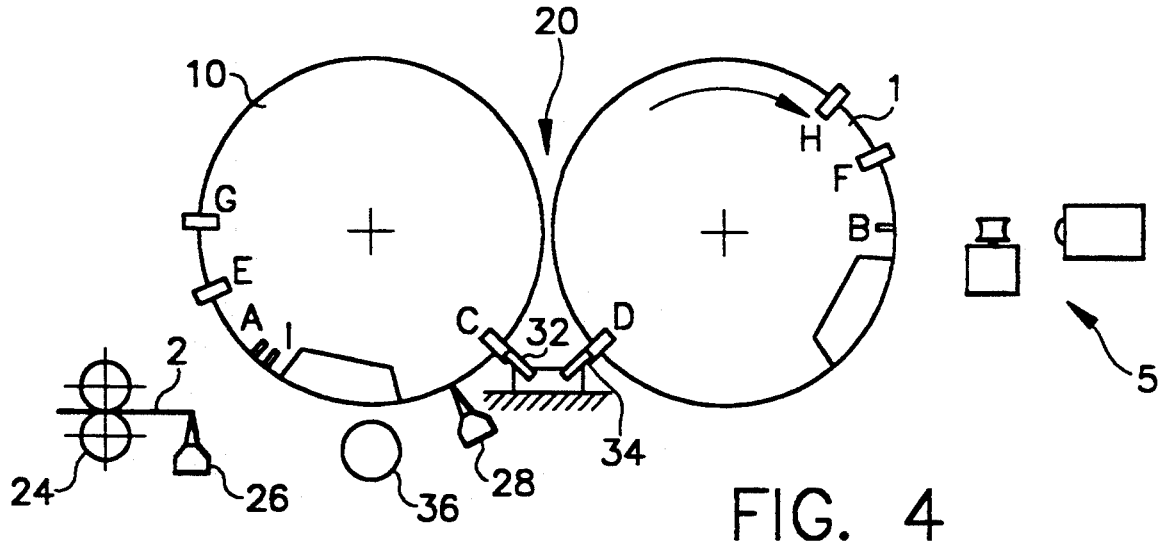
Figure 5:
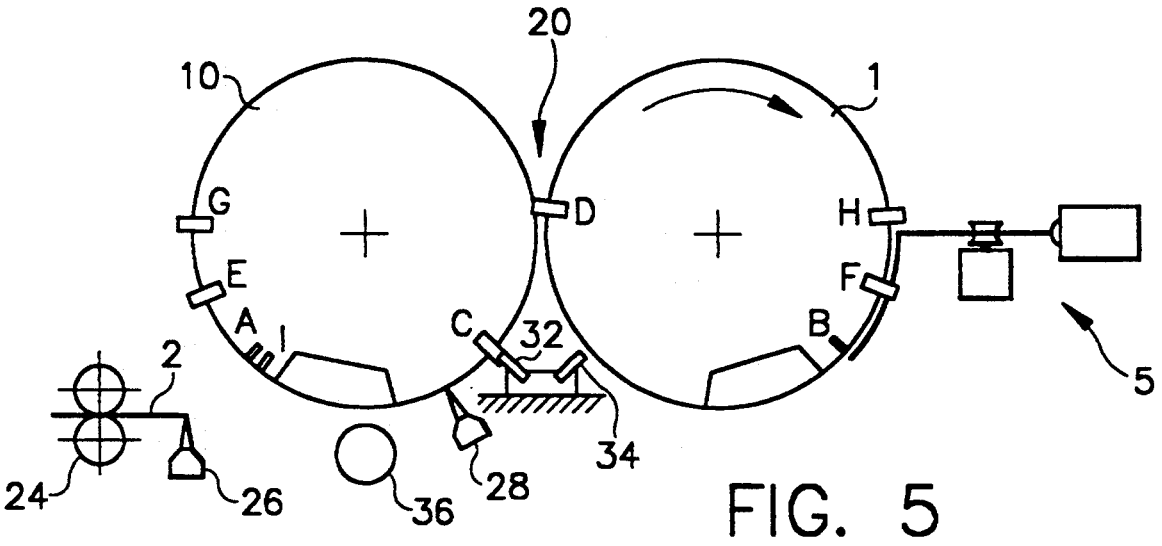
Figure 6:
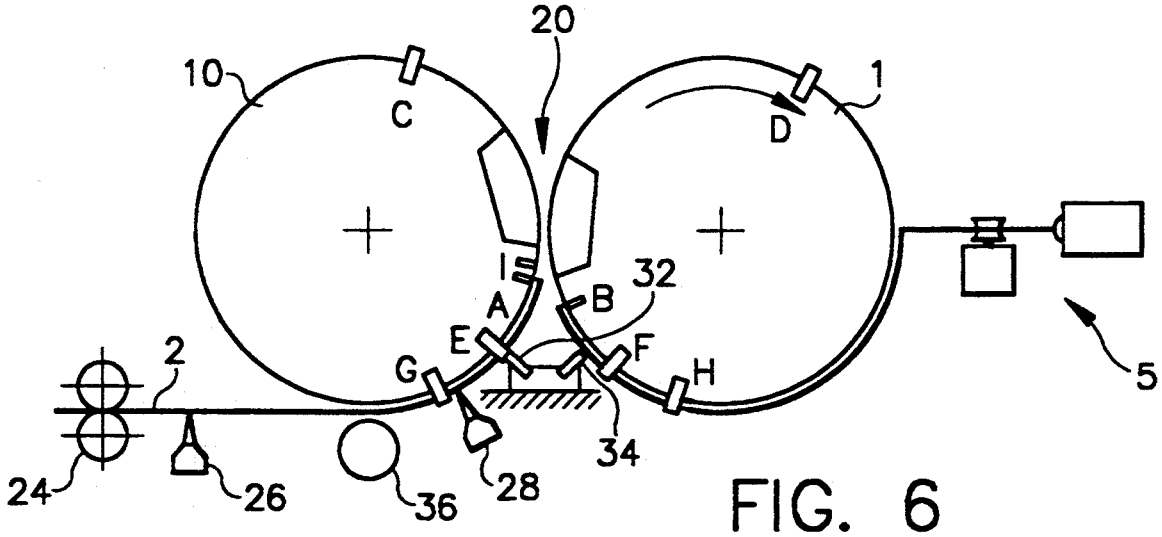
Figure 7:
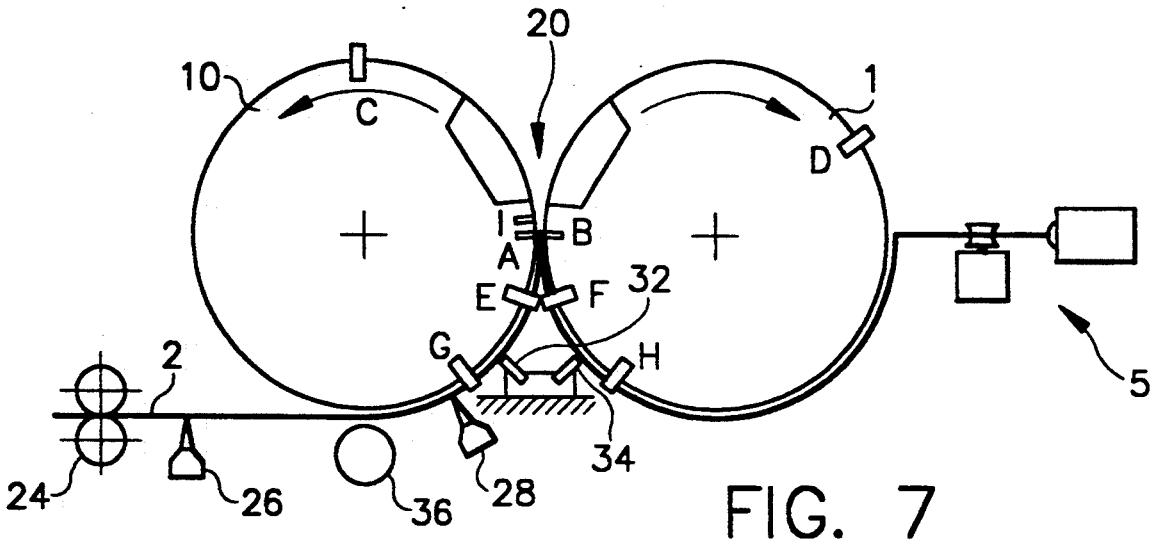
Figure 8:
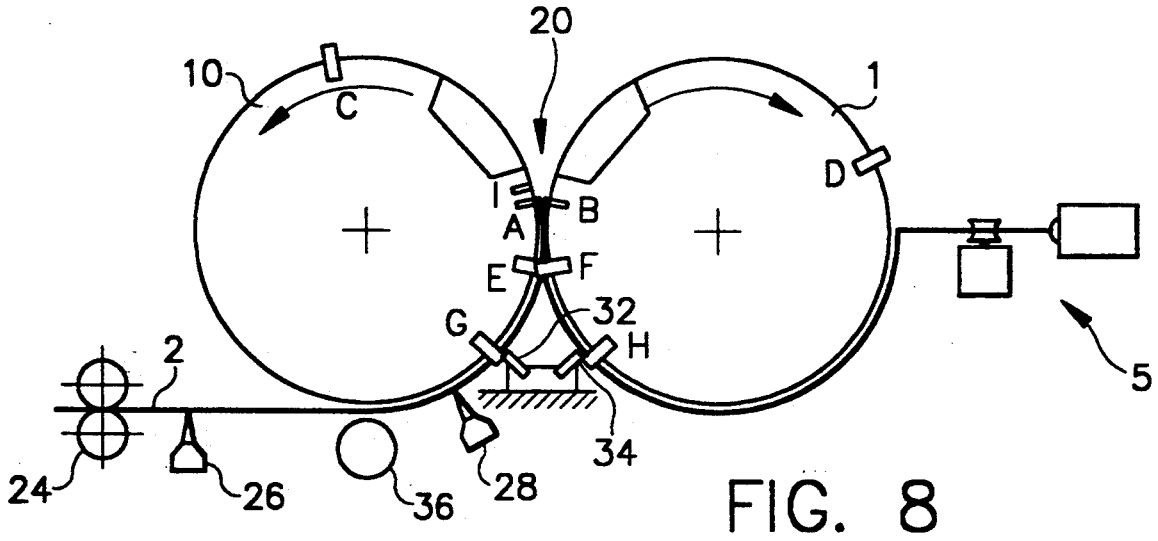

In operation, the receiving sheet is stopped momentarily, as shown in FIGS. 2–5 at transfer sheet sensor 26. As shown in FIG. 3, transfer member 10 is rotated until flag C reaches transfer member position sensor 32 where transfer member 10 is stopped. As shown in FIG. 4, a flag D on image member 1, which is continuously rotating at a constant velocity, passes image member position sensor 34 thereby triggering the beginning of scan at a position B on the periphery of image member 1. As will be discussed later, the actual start of scan is not precisely known and will be determined and compensated for. As shown in FIG. 5, the image member 1 continues to rotate while transfer member 10 is stopped with flag C at sensor 32. As shown in FIG. 6, the electrostatic image formed on image member 1 is now approaching transfer zone 20. It has now been toned by one of toning stations 12, 14, 16 or 18 (FIG. 1). The leading edge of the toner image is at the same position as the leading edge of the electrostatic image, at approximately B on the periphery of image member 1. Independent of the creation of the image on image member 1, the receiving sheet is loaded onto the transfer member. This is accomplished by beginning the rotation of transfer member 10 and feeding the receiving sheet by actuation of registration rollers 24 onto the surface of the transfer member 10 at approximately the position A. As the receiving sheet reaches the surface of transfer member 10, roller 36 is moved into engagement with it, pressing it against that surface. As the leading edge of the receiving sheet passes leading edge sensor 28, the leading edge sensor 28 optically measures (calculates from known velocity) the distance between the leading edge I of indicating area 61 and the leading edge of receiving sheet 2 (FIG. 9). Transfer member 10 continues rotating until flag E reaches transfer member position sensor 32, where the transfer member stops. A flag F on image member 1 passes image member position sensor 34 providing a signal to logic and control 41. In response to this signal, transfer member 10 is started again after a predetermined delay. The amount of the delay is dependent upon the location of the leading edge of receiving sheet 2 as sensed by sensor 28 and upon the location of the leading edge of the toner image, as discussed below. Thus, this delay is varied by logic and control 41 according to the location of the leading edge of the receiving sheet with respect to the leading edge of indicating area 61 and the location of the leading edge of the toner image. For example, the nominal position may be the exact middle of area 61 and enough delay is built into the starting of movement of the transfer member to absorb the leading edge of the paper being out of position all the way up to a point almost reaching the beginning of indicating area 61. The beginning of rotation of transfer member 10 then is chosen by logic and control 41 to bring the leading edge of receiving sheet 2 through the transfer zone 20 directly opposite the leading edge of the toner image, as shown in FIG. 7.

After transfer is begun, either of two approaches can be followed. According to the preferred approach, usable when substantial pressure is used in transfer, the image member drives the transfer member by its frictional engagement in the transfer zone 20 until the trailing edge of the receiving sheet exits the transfer zone 20. At this point, variable speed motor 43 must again take over the drive of transfer member 10 and drive it until flag E again triggers sensor 32. Engagement of motor 43 is preferably controlled by timing from one of the flags, for example, the original triggering of sensor 34 by flag F. Additional flags G and H may be included on the transfer member and the image member, respectively, which would trigger sensors 32 and 34, respectively, when the image and recording sheet are well into the transfer zone. Triggering of sensors 32 and 34 by flags G and H allow comparison of the movements of the drums when driven by the image member drum 1. This allows a check on the actual registration of the system which can be used to feed forward for slow drift errors caused by thermal expansion or shutting the system down if a mechanical malfunction is affecting velocity of one of the drums.

Alternatively, transfer member 10 can be independently driven by motor 43 at precisely the same speed as motor 45 drives the image member 1 throughout the transfer. This approach is desirable if transfer involves extremely low pressure or if transfer is across a slight separation. For such a device, encoders on both image member 1 and transfer member 10 may be monitored to assure no variation in velocity between them.

The subsequent toner images to be transferred in registration with the first toner images are handled substantially the same way. That is, once the first transfer is finished, the transfer member is driven by motor 43 until it stops with flag E at sensor 32. Image member 1 rotates at its regular process speed until flag D triggers the beginning of a new scan. The rotation of transfer member 10 past leading edge sensor 28 produces a new correction signal for the position of the leading edge of receiving sheet 2. If receiving sheet 2 has been held well by the vacuum securing means 52 and 54, this should be the same correction signal as the first time around and can be omitted. However, if them is any slight creep of the receiving sheet, the new correction signal will assure proper registration of the second image despite that creep.

It may be necessary to separate transfer member 10 from image member 1 when transfer is not taking place. U.S. Pat. No. 5,047,791, referred to above, discloses several mechanisms for accomplishing that separation. It is incorporated by reference herein.

It is not necessary to stop the transfer member as is done with both flags C and E at sensor 32. The speed of the drum can be chosen so that it moves at varying speeds but does not stop. The final registration speed is determined by whichever of flags E and F last passes sensors 32 or 34, respectively. Utilizing the known location of the leading edge of the toner image, the known location of the leading edge of the receiving sheet and the velocity of both the image member and the transfer member an appropriate speed adjustment can be made by logic and control 41.

If a laser is used for exposure, the start of exposure flag D is somewhat less precise than desired in determining the leading edge of the image. That is, because the polygon or other scanner used for the laser is generally in an indeterminate position with respect to the angular position of image member 1. However, various mechanisms are available for determining, after the start of scan signal, when the scan actually began. For example, the location of the polygon itself can be monitored. The location of the initial scan line, i.e., the actual start of scan, determines the location of the leading edge of the electrostatic image formed by the scan. Preferably, the determined start of scan is used by the logic and control in controlling the transfer drum to assure coincidence of the leading edges in transfer. However, it is known in the art to detect the presence or absence of a toner image on an image member. Thus, a sensor can be positioned to detect the leading edge of the toner image optically. This is more expensive and not as reliable as determining the start of scan but would have an advantage if there was any irregularity in the motion of the image member of being accomplished closer in time to actual transfer.

Thus, the logic and control has an input (from flag F passing sensor 34) indicative of the position of the leading edge of the toner image and inputs (from sensor 28 and the arrival of flag E at sensor 32) from which it can determine the leading edge of a receiving sheet and uses the inputs to superpose the two leading edges on each other.

This approach provides precise registration for all images with respect to the leading edge of the receiving sheet regardless of the accuracy in positioning the receiving sheet or maintaining it between images transferred. Such precision is important in high quality imaging of the type described which is done up to the edge of the sheet, thereby eliminating the necessity for cropping. It is also important in any system in which the receiving sheet has a tendency to creep or otherwise move during its time on drum 10.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

a transfer member movable through an endless path through a transfer zone, means for securing a receiving sheet having a leading edge to the transfer member for movement through at least a portion of the endless path of the transfer member including the transfer zone, an image member movable through an endless path through transfer relation with a secured receiving sheet in the transfer zone, means for forming an electrostatic image having a leading edge on the image member, means for applying toner to the electrostatic image to form a toner image having a leading edge on the image member, first determining means for determining the location of the leading edge of the electrostatic or toner image on the image member, sensible means associated with the transfer member indicative of the approximate location of the leading edge of a secured receiving sheet, second determining means for determining the distance along the endless path of the transfer member between the actual leading edge of the receiving sheet and the sensible means indicative of the approximate location, third determining means for determining the location of said sensible means indicative of said approximate location, and logic and control including means for adjusting the motion of the transfer member through its endless path to assure a predetermined spacial relationship between the leading edge of the toner image and the leading edge of the receiving sheet in the transfer zone in response to said first, second and third determining means, wherein said sensible means indicative of the approximate location of the leading edge of a receiving sheet is an area on the transfer member having a characteristic which is distinguishable from the leading edge of the receiving sheet and which area has a leading edge itself also distinguishable from the rest of the transfer member and wherein the means for determining the distance between the leading edge of the receiving sheet and the sensible means includes means for sensing the distinguishing characteristic of the area at both its leading edge and at the leading edge of the receiving sheet.

2. Image forming apparatus according to claim 1 wherein said image forming means includes means for forming a series of electrostatic images and means for applying a different color toner to each of said electrostatic images and wherein said apparatus includes means for repeatedly moving said transfer member through its endless path to superpose the different color toner images on the receiving sheet to form a multicolor image and said logic and control applies a single input from said second determining means for all images superposed.

3. Image forming apparatus according to claim 1 wherein said image member is a drum and said apparatus includes means for driving said image member at a constant speed.

4. Image forming apparatus according to claim 3 wherein said transfer member is a transfer drum and said apparatus further includes means for driving said transfer member at a variable speed controlled by said logic and control in response to said first, second and third determining means. applies a single input from said second determining means for all images superposed.

5. Image forming apparatus according to claim 1 wherein said area is optically distinguishable from the receiving sheet and the surrounding portion of the transfer member and the means for sensing includes means for optically sensing both the leading edge of the area and the leading edge of the receiving sheet.

6. Image forming apparatus according to claim 1 wherein said logic and control further includes means for stopping said transfer member in response to said third determining means and for then starting said transfer member for movement through said transfer zone in response to said first determining means.

* * * * *

UNITED STATES PATENT AND TRADEMARK OFFICE

CERTIFICATE OF CORRECTION

PATENT NO. : 5,339,136

DATED : August 16, 1994

INVENTOR(S) : Michael H. Parsons, Kevin M. Johnson

It is certified that error appears in the above-indentified patent and that said Letters Patent is hereby corrected as shown below:

| | |
|---|---|
| Column 8, lines 18-19 | Delete "applies a single input from said second determining means for all images superposed." |

Signed and Sealed this

Eighth Day of November, 1994

*Attest:*

*Attesting Officer*

BRUCE LEHMAN

*Commissioner of Patents and Trademarks*